US006163925A

United States Patent [19]

Lin

[11] Patent Number: 6,163,925

[45] Date of Patent: Dec. 26, 2000

[54] HANDLE FOR LUGGAGE

[75] Inventor: Jer Hong Lin, Taipei, Taiwan

[73] Assignee: Chan Khong Technology Co., Ltd., Taipei, Taiwan

[21] Appl. No.: 09/298,921

[22] Filed: Apr. 26, 1999

[30] Foreign Application Priority Data

Oct. 30, 1998 [TW] Taiwan ..... 87217953

[51] Int. Cl.[7] ..... A45C 7/00

[52] U.S. Cl. ..... 16/113.1; 190/115; 280/655; 280/47.315

[58] Field of Search ..... 16/113.1, 114.1, 16/405, 429; 280/655, 655.1, 47.315, 47.317; 190/115, 18 A

[56] References Cited

U.S. PATENT DOCUMENTS

| | | | |
|---|---|---|---|
| 4,256,320 | 3/1981 | Hager | 190/18 A |
| 5,566,798 | 10/1996 | Tsai | 190/115 |
| 5,613,273 | 3/1997 | Tsia | 16/113.1 |
| 5,624,012 | 4/1997 | Wang | 16/113.1 |
| 5,692,266 | 12/1997 | Tsia | 16/113.1 |
| 5,996,177 | 12/1999 | Cheng | 16/113.1 |

*Primary Examiner*—Chuck Y. Mah
*Attorney, Agent, or Firm*—Dougherty & Troxell

[57] ABSTRACT

The present invention relates to an improved handle for luggage in which the locking button of the retractable handle is disposed on the top of the handle. The top surface of the handle has an arch shape which slopes from one side to the other. The protrudent height of the button is flush with the higher side of the slope, so that the button will not be actuated unintentionally and the towing tubes will not be retracted unexpectedly when the handle is held while pulling or pushing the luggage.

8 Claims, 6 Drawing Sheets

HANDLE FOR LUGGAGE

BACKGROUND OF THE INVENTION

The present invention relates to an improved handle for luggage and more particularly to an improvement of the handle structure. The improvement is made such that the locking button of the luggage will note be actuated unintentionally when the handle of the luggage is held and the luggage is being pulled or pushed.

Usually, while carrying a luggage, the wheels and the retractable handles are mounted at the bottom and at the top of the luggage respectively, so that the loads exerted on the arms can be reduced if the luggage is loaded heavily. Most of luggages in use are the towing type, as described in U.S. Pat. No. 5,566,798 "TRUNK WITH A CONCEALABLE RETRACTABLE HANDLE".

In these designs, the buttons on the handles always protrude some height over the top of handles. A typical handle of this type is shown in FIGS. 5–8.

As shown in FIG. 5, most of the buttons which are located on the handles 21 of the towing rods 20 protrude some height over the handle surface. The side view of FIG. 5 is shown in FIG. 6 in which the button 210 is disposed exactly at the center of the handle 21. On the top of the handle, there are two edges 211, 212, with angles located at both side of the button 210. When the handle is held, the fingers face downwards and the palm faces the edges 211, 212, of the top surface. As a result, the button 210 is pressed with full contact. It is well known that the button 210 is the vital part in controlling tie towing rods to extend or retract. When the towing rods are in their extended position, pressing the button will enable the towing rods to be retracted. When luggage is being pulled (shown in FIG. 7) or pushed (shown in FIG. 8), the palm of the user is in a full contact with the button 210 and may inadvertently apply a force on the button 210. This causes the button to actuate and consequently causes the retractable inner rods to be unexpectedly pushed into outer rods. Therefore it is very inconvenient in using such luggage because of this defect.

SUMMARY OF THE INVENTION

The primary object of the present invention is to improve the defect of the conventional handle mentioned above and provide an improved handle for luggage.

Another object of the present invention is to provide an improved handle for luggage in which the locking button of the handle is disposed eccentrically on the top of the handle with an oblique arch face, When the handle is held and a force is applied, the button will not be actuated by accident and the handle will stay in the normal position.

The other object of the present invention is to provide a handle for luggage in which the top surface of the handle is an oblique arch, namely, one end is higher than the other. This prevents the locking button from accidentally being triggered when the handle is held tightly.

In order to fulfill the above objects of the present invention, a handle for luggage in the present invention comprises: a handle; a pair of retractable inner tubes disposed under the handle; a brace attached to the top of a luggage; a pair of outer tubes disposed under the brace; a bracket disposed under the outer tubes; wherein an upper arch portion of the handle near a central top surface of a button has a first side portion of the top surface and a lower arch portion of the handle near the central top surface of the button has a second side portion of the top surface, the top surface of the button being located between the first side portion and the second side portion top surfaces and the top surface of the button is flush with or below the arch portion which interconnects the upper and the lower arch surfaces. When the handle is held and a force is applied, there is no force applied on the top surface of the button and the button can be prevented from being inadvertently actuated.

These and other objects, advantages and novel features of the invention will become more apparent from the following detailed description when taken in conjunction with the accompanying drawings.

DETAILED DESCRIPTION OF THE PREFERRED EMBODIMENTS

Figure 1:
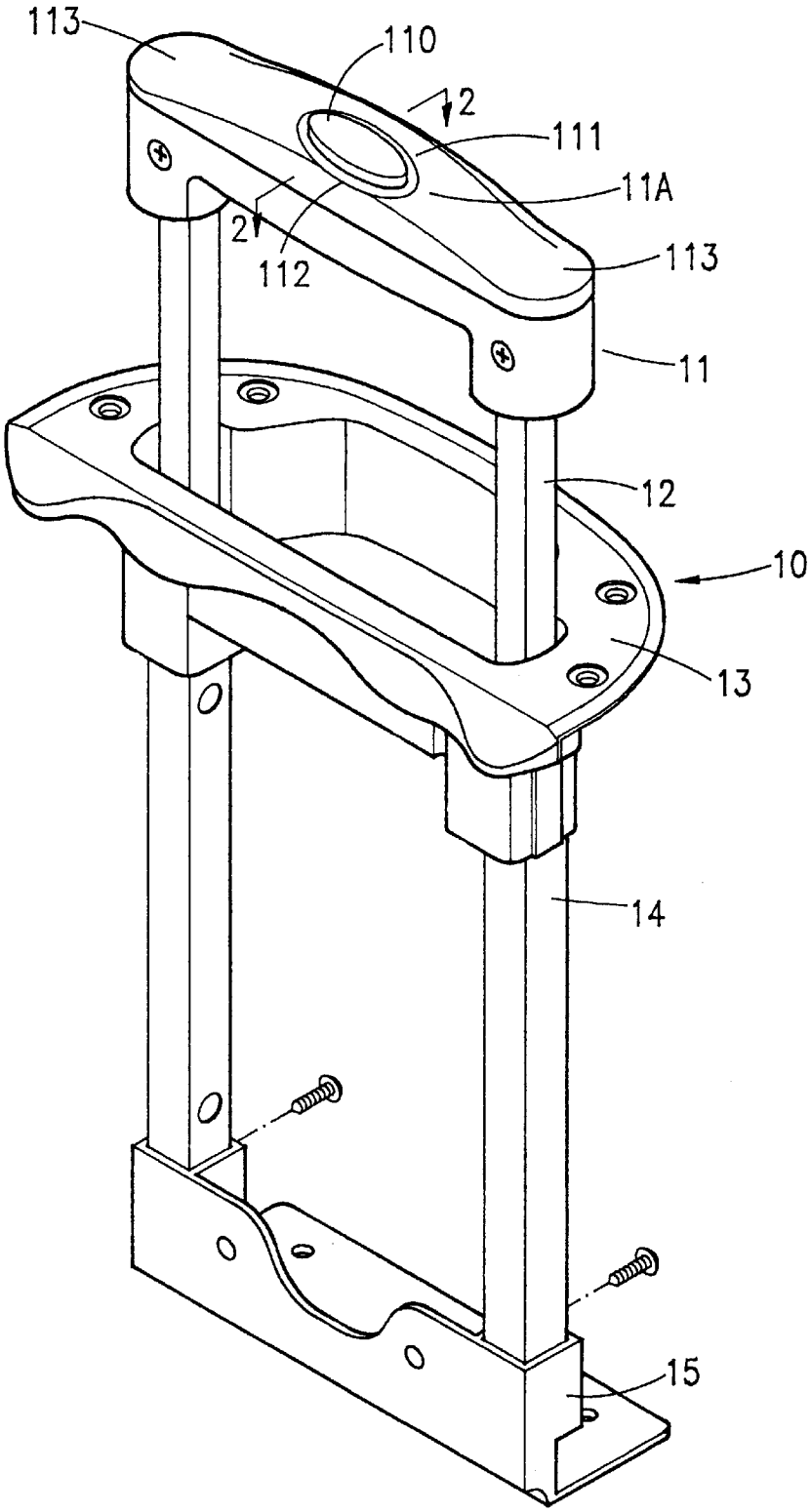
FIG. 1 is a perspective view of the retractable handle assembly in accordance with the invention.

As shown in FIG. 1, the retractable handle assembly 10 of the present invention comprises a handle 11 with button 110 on a top center, two retractable inner tubes 12 under the retractable handle 11, a brace 13 which is attached on the luggage, two outer tubes 14 attached under the brace 13, and a bracket 15 attached under the outer tubes 14.

Figure 2:
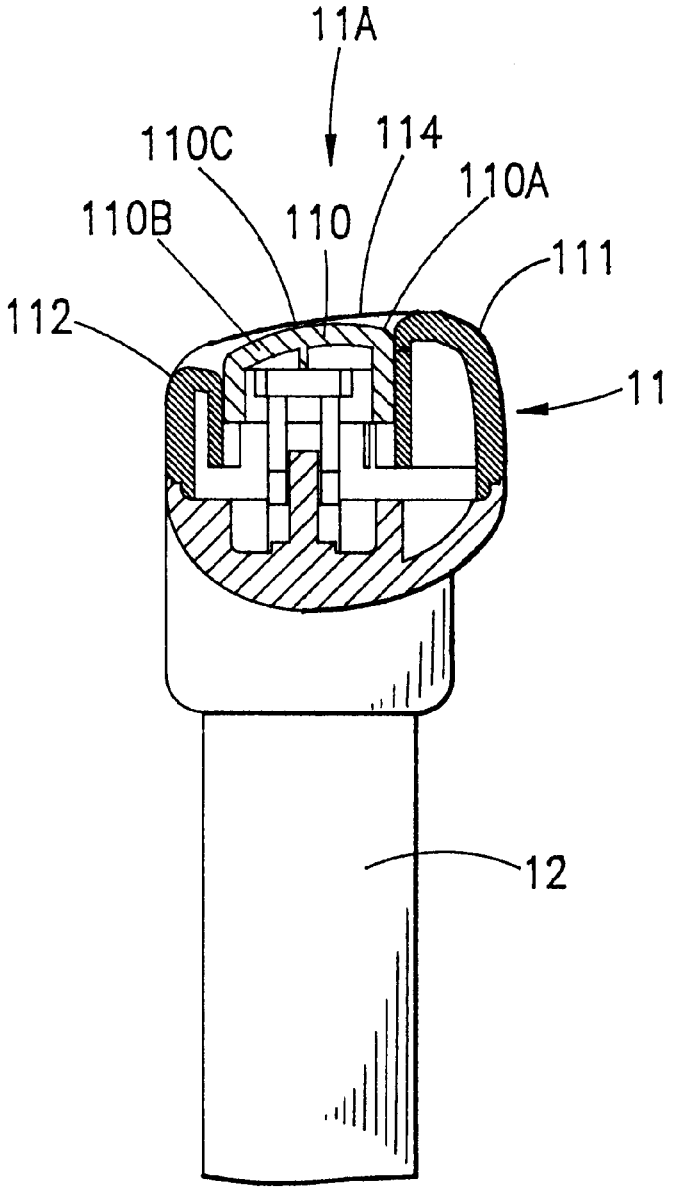
FIG. 2 is a cross sectional view of the handle in accordance with the present invention, taken along line 2—2 in FIG. 1.

As shown in FIG. 1, the improvement of the retractable handle 11 of the present invention is that the top center of the handle 11 is formed with a convex arch portion 11A and both sides of the handle are the lower end of arch portion 113—113. A button 110 is disposed at the top center of the convex arch portion. It is clearly shown in FIG. 2 that the two sides of the lateral cross section of the arch portion 11A near the button are substantially flush with the height of the button.

The height of right side 110A of the button 110 is higher than that of the left side 110B of the button and the central part 110C is the highest. Considering the whole top surface of the handle, the right side 111 of the handle around the button 110 is higher than the left side 112 of the handle. It makes the top surface of the handle form an oblique surface which is higher on the right side and lower on the left side and the highest point of the button 110 is located only at the central part 110C.

Figure 3:
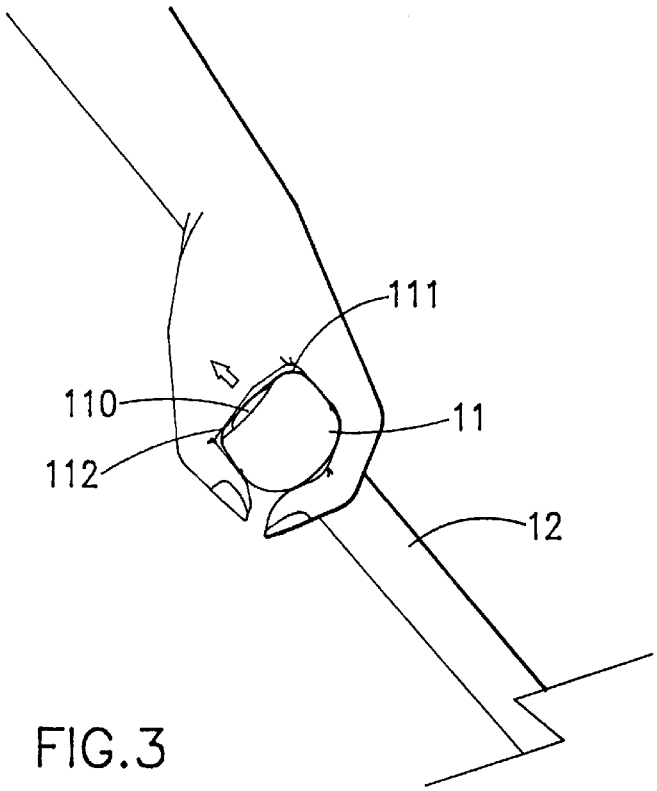
FIG. 3 is a schematic view showing a force-reaction relation between the button and the palm in the present invention when the luggage is pulled.
Figure 4:
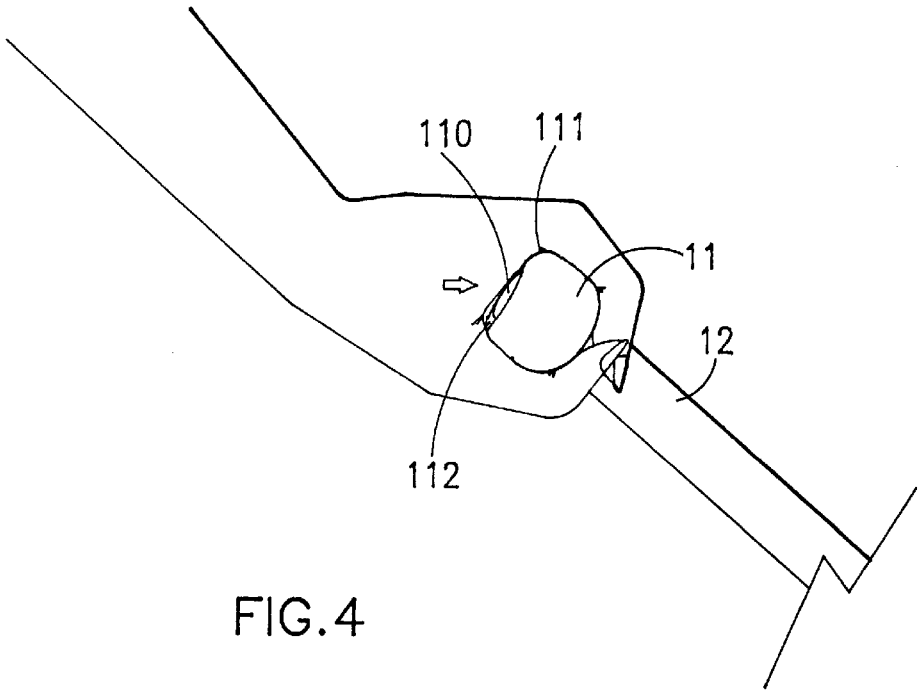
FIG. 4 is a schematic view showing a force-reaction relation between the button and the palm in the present invention when the luggage is pushed.
Figure 5:
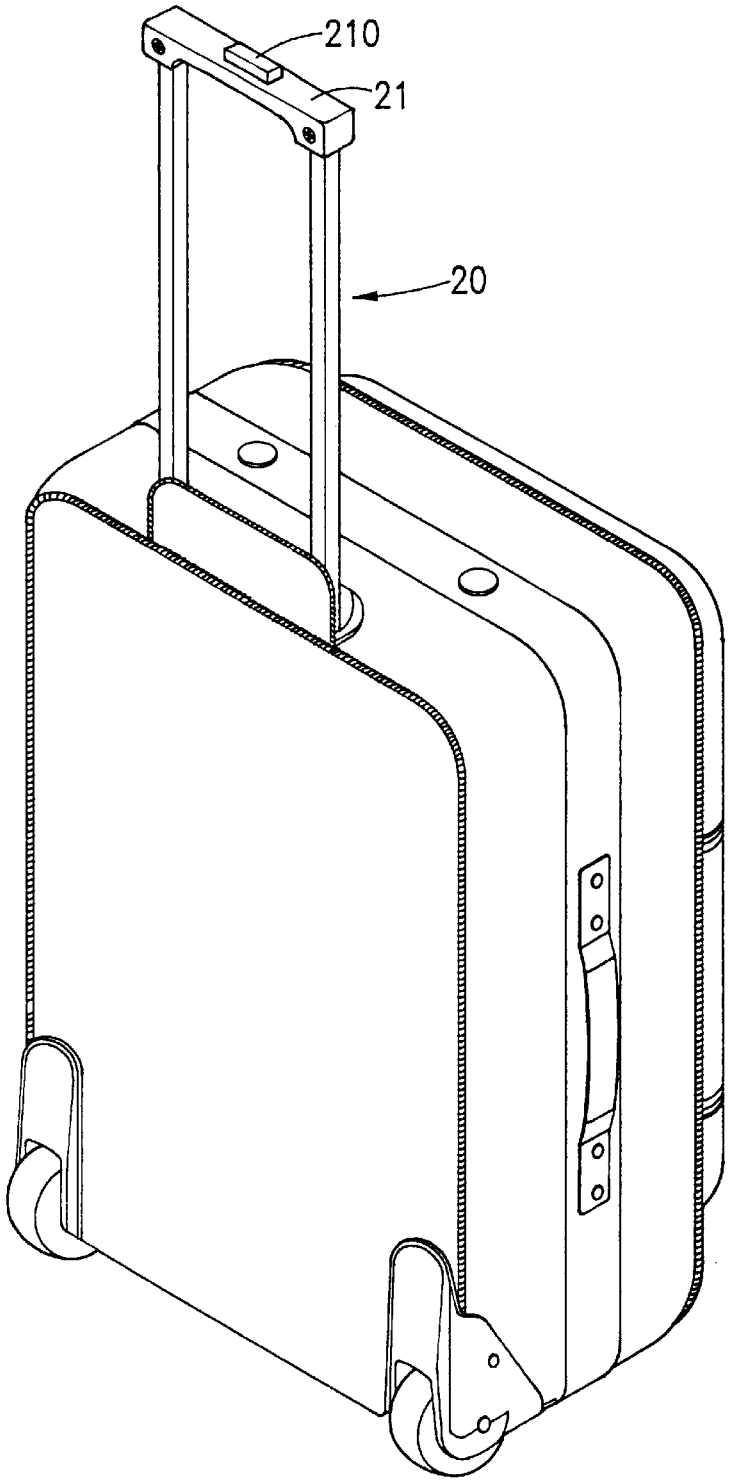
FIG.5(PRIOR ART)
FIG. 5 is a perspective view of a typical luggage with a retractable handle of the prior art.
Figure 6:
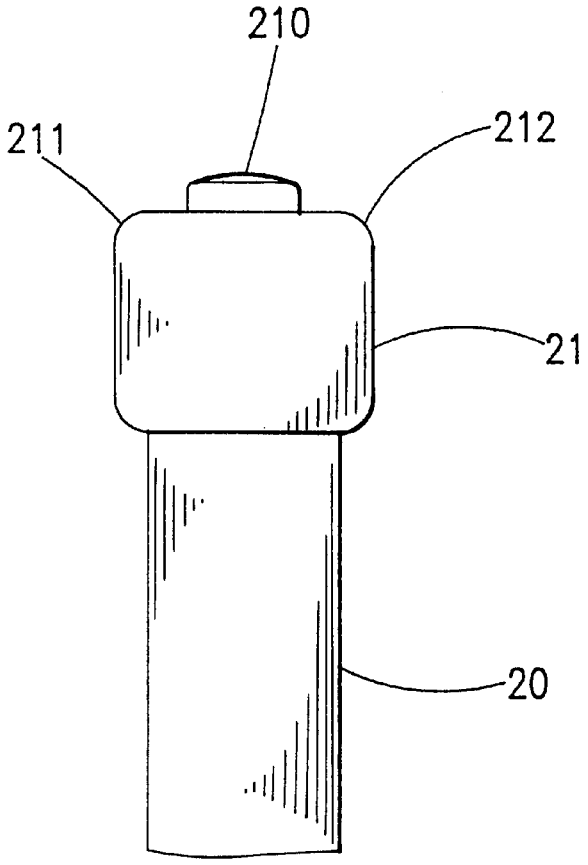
FIG.6(PRIOR ART)
FIG. 6 is a side view of the button on a handle in FIG. 5.
Figure 8:
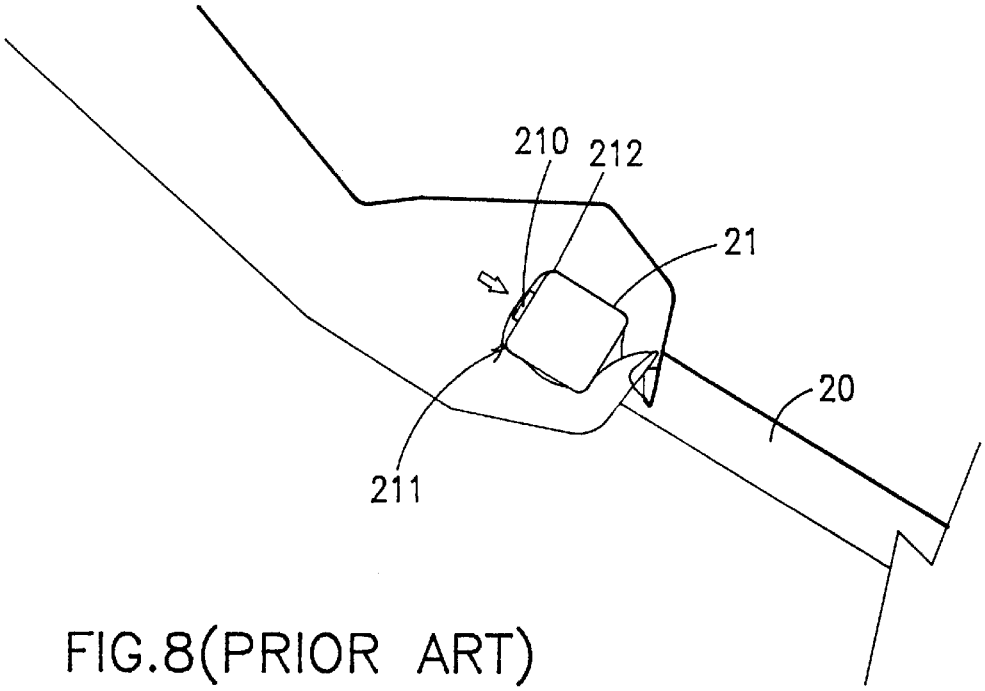
FIG.8(PRIOR ART)
FIG. 8 is a schematic view showing a force-reaction relation between the button and the palm when the luggage in FIG. 5 is pushed.
Figure 7:
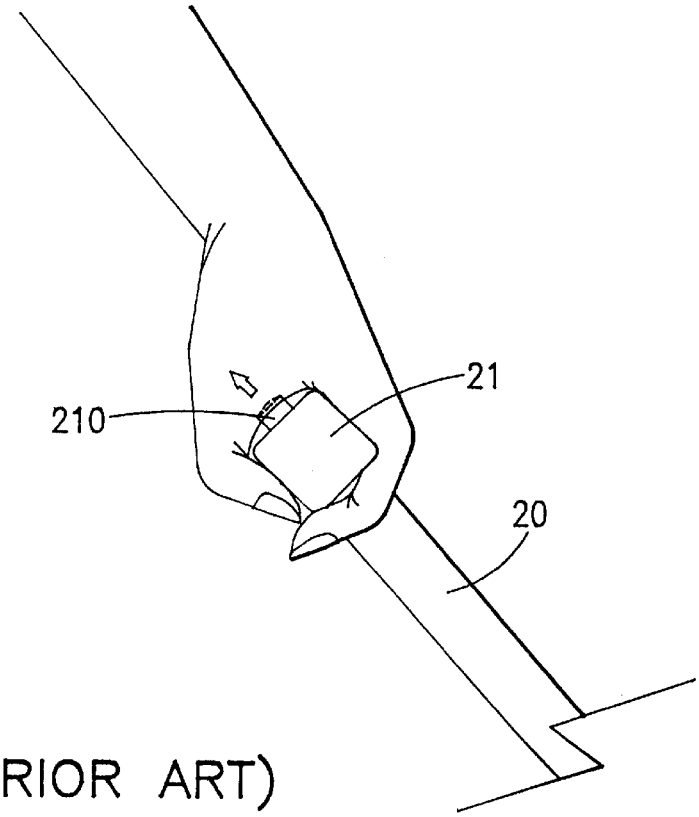
FIG.7(PRIOR ART)
FIG. 7 is a schematic view showing a force-reaction relation between the button and the palm when the luggage in FIG. 5 is pulled.

In other words, near the button 110 of the handle according to the present invention, the right side portion 111 with respect to the button 110 is higher than the left side portion 112 with respect to the button 110 with a difference between 0.5~5 mm according to experimental results. When we move a luggage by pulling or pushing, the force applied by hand cannot directly press on the button 110, as shown in FIG. 3 and FIG. 4.

Furthermore, the palm that holds the handle is concave inwards and the central part 110C of the button 110 is unlikely to be contacted. As a result, the button is also unlikely to be triggered. This is therefore the important feature that is provided by the present invention.

What is claimed is:

1. A handle assembly for luggage comprising:

a handle having a button with a top surface;

a pair of outer tubes;

a pair of retractable inner tubes extending from the handle and being slidably received within said outer tubes;

wherein the handle has an upper arch portion adjacent to a first portion of the top surface of the button and a lower arch portion adjacent to a second portion of the top surface of the button, the top surface of the button being located between the upper arch portion and the lower arch portion of the handle such that when the handle is held and a force is applied by a palm of a user, there is no force applied on the top surface of the button to prevent the button from being inadvertently actuated.

2. The handle assembly for luggage as claimed in claim 1, wherein a center of the button on the handle is located eccentrically on the handle.

3. The handle assembly for luggage as claimed in claim 1, wherein the upper and lower arch portions are convex at a center and lower at opposite ends.

4. The handle assembly for luggage as claimed in claim 1, wherein a height of the first portion of the top surface of the button is larger than a height of the second portion of the top surface of the button by a constant dimension.

5. The handle assembly for luggage as claimed in claim 4, wherein the constant dimension is between 0.5~5 mm.

6. The handle assembly for luggage as claimed in claim 1, wherein the button has an arched top surface with a first arched surface portion adjacent to the upper arch portion of the handle having a height greater than a second arched surface portion adjacent to the lower arch portion of the handle.

7. The handle assembly for luggage as claimed in claim 1, wherein the top surface of the button is below an arch portion of the handle which interconnects the upper and the lower arch portions of the handle.

8. The handle assembly for luggage as claimed in claim 1, wherein the top surface of the button is substantially flush with an arch portion of the handle which interconnects the upper and the lower arch portions of the handle.

* * * * *